US006817477B2

(12) United States Patent
McMurray et al.

(10) Patent No.: US 6,817,477 B2
(45) Date of Patent: Nov. 16, 2004

(54) DEVICE FOR LOCKING FIREARMS AND OTHER ARTICLES

(75) Inventors: William McMurray, Detroit, MI (US); Matthew C. Mullen, Westland, MI (US)

(73) Assignee: The Rac Holding Company, L.L.C., Southfield, MI (US)

( * ) Notice: Subject to any disclaimer, the term of this patent is extended or adjusted under 35 U.S.C. 154(b) by 0 days.

(21) Appl. No.: 10/346,627

(22) Filed: Jan. 17, 2003

(65) Prior Publication Data

US 2003/0106862 A1 Jun. 12, 2003

Related U.S. Application Data

(63) Continuation-in-part of application No. 09/874,751, filed on Jun. 5, 2001, now abandoned.

(51) Int. Cl.[7] ..... E05B 73/00
(52) U.S. Cl. ..... 211/4; 211/64
(58) Field of Search ..... 211/4, 7, 8, 60.1, 211/64, 70.6, 59.1, 105.1, 123, 124, 193; 42/94; 206/317; 248/551–553, 251; 70/58, 59, 61–63, 77, 158, 46, 52

(56) References Cited

U.S. PATENT DOCUMENTS

| | | | | | |
|---|---|---|---|---|---|
| 920,132 | A | | 5/1909 | Greener | |
| 1,033,915 | A | | 7/1912 | McDonald | 211/4 |
| 3,419,154 | A | | 12/1968 | Shapiro et al. | 211/7 |
| 3,659,721 | A | | 5/1972 | Parillo | 211/4 |
| 3,982,633 | A | | 9/1976 | Pennington | 211/4 |
| 4,139,100 | A | * | 2/1979 | Reed | 211/4 |
| 4,198,026 | A | * | 4/1980 | Capolupo | 248/552 |
| 4,204,601 | A | | 5/1980 | Thomas | 211/4 |
| 4,254,879 | A | | 3/1981 | Maule | 211/4 |
| 4,462,497 | A | | 7/1984 | Maule | 211/7 |
| 4,624,372 | A | * | 11/1986 | Brolin | 211/4 |
| 4,844,257 | A | | 7/1989 | Seynhaeve | 206/279 |
| 4,949,559 | A | * | 8/1990 | Glines | 70/19 |
| 5,026,013 | A | | 6/1991 | Robbins | 248/223.1 |
| 5,154,072 | A | | 10/1992 | Leyden | 70/18 |
| 5,178,283 | A | | 1/1993 | Ennis | 211/4 |
| 5,282,539 | A | * | 2/1994 | Saathoff | 211/64 |
| 5,287,972 | A | | 2/1994 | Saathoff | 211/64 |
| 5,339,966 | A | * | 8/1994 | Bastiaans | 211/4 |
| 5,509,542 | A | | 4/1996 | Simmerman et al. | 211/124 |
| 5,675,999 | A | | 10/1997 | Carlstrom | 70/18 |
| 5,683,021 | A | | 11/1997 | Setina | 70/162 |
| 5,823,358 | A | | 10/1998 | Leyden et al. | 211/8 |
| 5,887,730 | A | * | 3/1999 | St. George | 211/4 |
| 6,012,692 | A | | 1/2000 | Meck | 248/251 |
| 6,044,984 | A | * | 4/2000 | Crosby et al. | 211/70.6 |
| 6,113,045 | A | | 9/2000 | Kuo | 211/105 |
| 6,142,313 | A | * | 11/2000 | Young | 211/4 |
| 6,330,815 | B1 | | 12/2001 | Duncan | 70/58 |
| 6,364,124 | B1 | * | 4/2002 | Chen | 211/4 |
| 6,478,165 | B1 | * | 11/2002 | Noble | 211/4 |
| 6,491,169 | B1 | * | 12/2002 | Salonen | 211/4 |
| 2002/0179546 | A1 | * | 12/2002 | McMurray et al. | 211/4 |

* cited by examiner

*Primary Examiner*—Carl D. Friedman
*Assistant Examiner*—Jennifer E. Novosad
(74) *Attorney, Agent, or Firm*—Gifford, Krass, Groh, Sprinkle, Anderson & Citkowski, P.C.

(57) ABSTRACT

A mounting apparatus includes a base, a first support member position on the base, a second support member positioned on the base and spaced apart from the first support member and a movable locking bar that extends between the first and second support member. The base, locking bar and support member cooperating to releaseably secure one or more devices.

18 Claims, 3 Drawing Sheets

DEVICE FOR LOCKING FIREARMS AND OTHER ARTICLES

CROSS-REFERENCE TO RELATED APPLICATION

This application is a continuation-in-part of U.S. patent application Ser. No. 09/874,751, filed Jun. 6, 2001, now abandoned which is incorporated herein by reference.

BACKGROUND OF THE INVENTION

1. Field of the Invention

The present invention is directed to a mounting apparatus. More particularly, the present invention is directed to an apparatus for safely and securely mounting or displaying firearms, tools and the like.

2. Description of the Prior Art

The safekeeping of firearms is an issue of considerable importance to every gun owner; particularly gun owners who are parents. Generally, it is not enough to simply "lock up" a firearm. Additional, precautions should also be taken to ensure that a firearm cannot be discharged even it is locked away in a secure cabinet or display case.

The safekeeping devices, like firearms, or even power tools, also presents a considerable dilemma for firearm retailers. Typically, the retailer wants prospective purchasers to "get a feel for" the device by allowing those purchasers to closely examine the product. However, that examination must not come with a risk of security to the retailer or other purchasers.

In order to address similar concerns regarding the potential theft of retail goods a variety of stands and mounts have been developed in the prior art. For example, U.S. Pat. No. 4,462,497 to Maule discloses a display stand including a base that has at each end an outwardly extending rod. A crossbar is pivotally secured to an end of one rod and extends parallel to the base to engage a lock that is positioned on the other end of the rod. Using this system, a retailer can publicly display and allow examination of a variety of objects without worrying about possible theft or misuse.

A similar type of device is disclosed in U.S. Pat. No. 4,254,879, which is also issued to Maule. In this system, the crossbar and one rod include circular end portions that are engaged and secured together by a lock.

A gun rack is disclosed in U.S. Pat. No. 5,287,972 to Saathoff. The gun rack includes a number of horizontally extending sleeves that are used for supporting a firearm. A pair of vertically extending crossbars extend over the sleeves to secure the firearm in the rack.

SUMMARY OF THE INVENTION

The present invention concerns a mounting apparatus for a device such as a firearm or a tool. The apparatus includes a base, a first support member, a second support member and a locking bar that extends between the first support member and said second support member.

The base includes such things as a vertically directed surface (e.g., a wall), a flat surface (e.g., a table top) or a plate (e.g., mounting plate). The first support member has a base (preferably a conical base) that is positioned on the base of the apparatus and a support rod that extends from the base of the first support member. The support rod has a first end and a second end. The first end is secured to the conical base of the first support member. In the preferred embodiment, the second support member is engaged by the locking bar. The second support member includes a base (preferably a conical base) and a lock that can engage the locking bar.

BRIEF DESCRIPTION OF THE DRAWINGS

Reference is made to the attached drawings, when read in conjunction with the following specification, wherein like reference numerals refer to like parts throughout the several views and in which.

DETAILED DESCRIPTION

Figure 1:
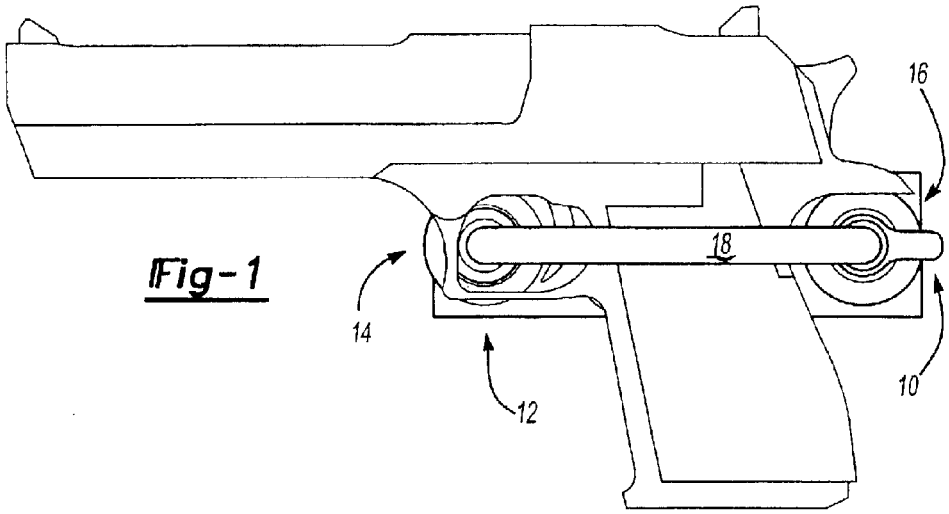
FIG. 1 is a side environmental view showing a preferred embodiment of an apparatus constructed in accordance with the present invention being used with a firearm.

Referring now to FIGS. 1–4, there is shown an mounting apparatus 10 constructed in accordance with a preferred embodiment of the present invention. The apparatus 10 includes a base 12, a first 14 and a second 16 support member positioned on the base 12 and a locking bar 18 that is moveably secured to the second support member 16 and adapted to engage the first support member 14.

Figure 2:
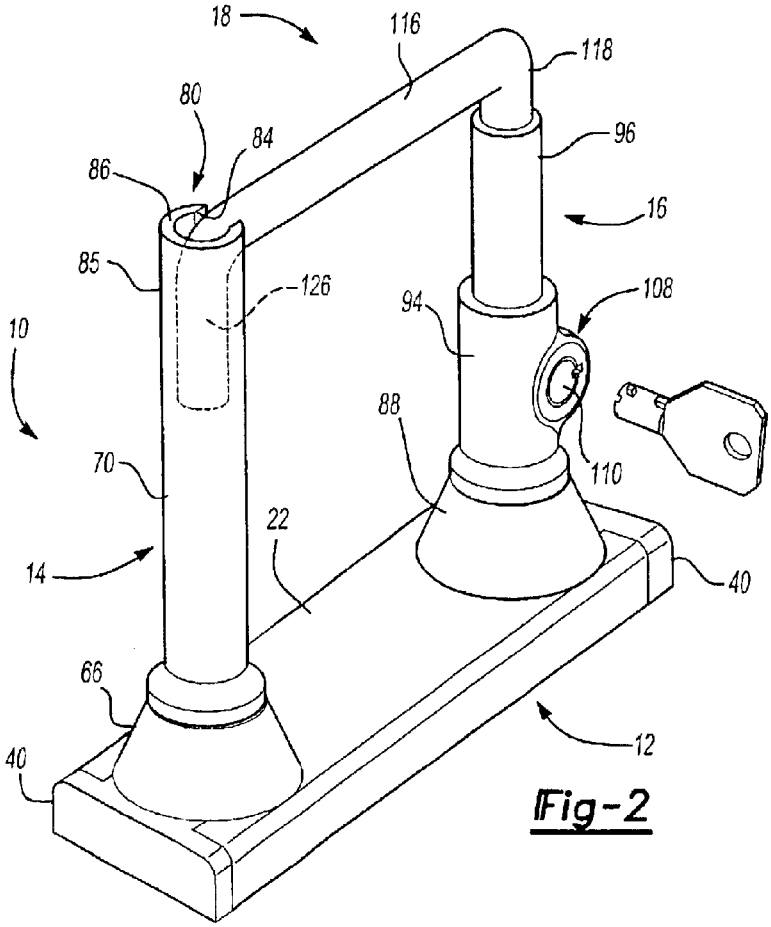
FIG. 2 is a perspective view of the preferred embodiment of the apparatus.
Figure 3:
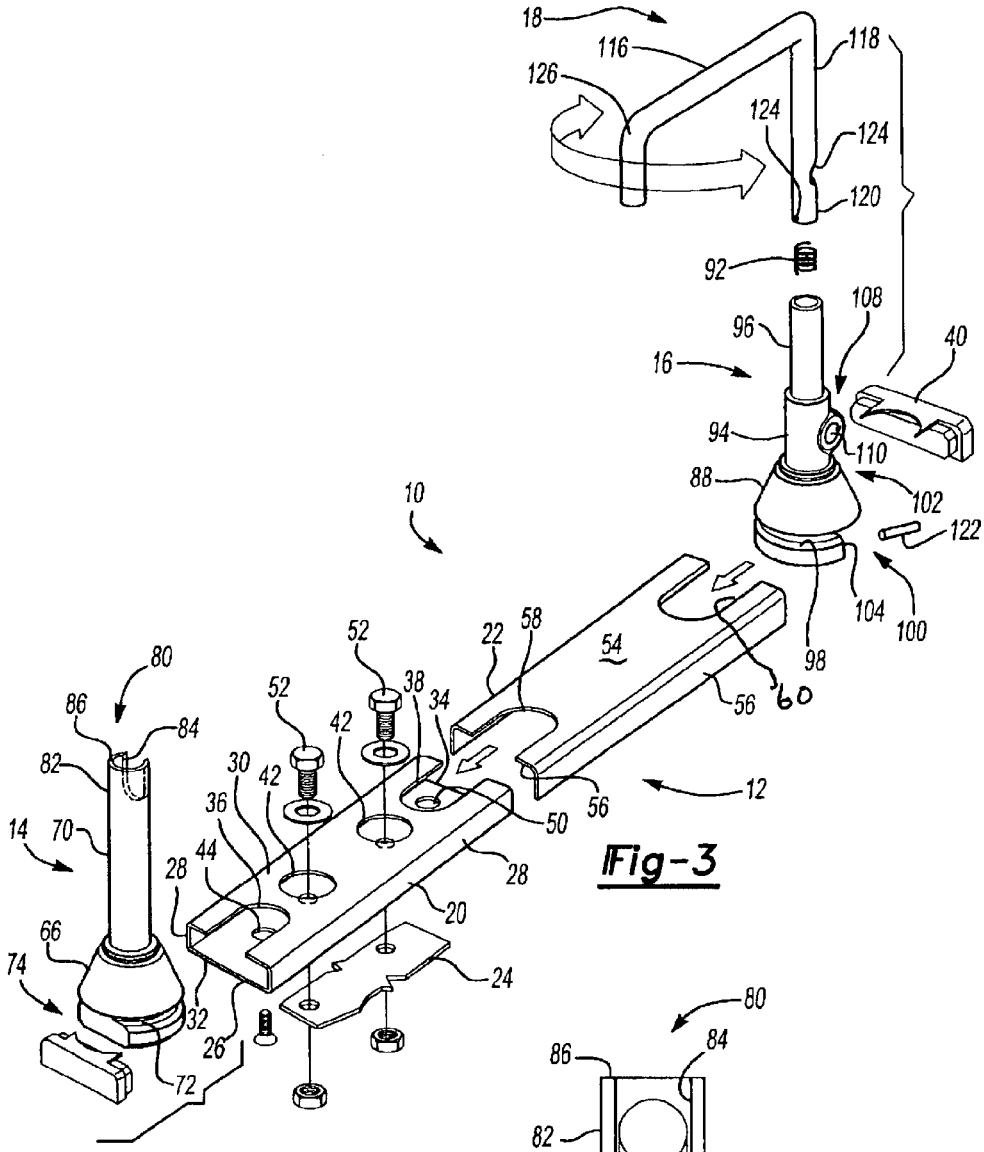
FIG. 3 is an exploded perspective view of the preferred embodiment.
Figure 5:
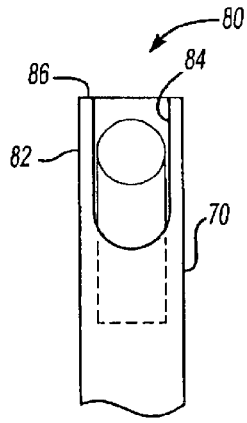
FIG. 5 is planar side view of the top end of a support rod of the preferred embodiment.

Still referring to FIGS. 1–4, and as best shown in FIG. 3, the base 12 of the present invention includes most any smooth surface, such as a vertically directed surface. A vertically directed surface is normally a wall or other vertical support that is provided with appropriate bracing for supporting the apparatus 10 of the present invention. Two inch by four inch support beams (not shown) may be provided within the vertically directed surface for appropriate support. Alternatively, the base 12 may include a tabletop (not shown) or the like. In a preferred embodiment, the base 12 includes a mounting plate 20, a faceplate 22 that is positioned over the mounting plate 20 and a backing plate 24. The mounting plate 20, faceplate 22 and backing plate 24 are preferably constructed of steel. However, other metals and alloys having the requisite strength and support characteristics may also be used in the construction of the base 12. For example, the normally outwardly visible faceplate 22 may be constructed of a stainless steel or otherwise be chrome plated.

The mounting plate 20 (see FIG. 3) is a rectangular, box-like structure that includes a lower surface 26, a pair of sidewalls 28 and an upper surface 30; the sidewalls 28 and surfaces 26, 30 defining an open interior for the mounting plate 20. The ends 32, 34 of the mounting plate 20 are open. A U-shaped opening 36, 38 is defined in each end 32, 34 of the upper surface 30 of the mounting plate 20 to facilitate (as will be described below) engagement with the first and second support members 14, 16. The ends 32, 34 of the mounting plate 20 are sealed by the insertion of plastic or metal end caps 40 following the positioning of the first and second support members 14, 16 in the U-shaped openings 36, 38.

A pair of circular apertures 42 (FIGS. 3–4) are defined in the upper surface 30 of the mounting plate 20 between the U-shaped openings 36, 38. Likewise, a series of four apertures 44, 46, 48, 50 are defined in the lower surface 26 of the mounting plate 20 and are in alignment with the U-shaped openings 36, 38 and apertures 42, respectively, of the upper surface 30. A pair of bolts 52 extend through the apertures 42 in the upper surface 30 and the lower surface 26 to secure the mounting plate 20 to the backing plate 24. Alternatively, or additionally, it will be appreciated by those having skill in the art that the mounting plate 20 and backing plate 24 can be used to secure the apparatus 10 to a wall or similar surface (not shown).

Referring to FIG. 3, the faceplate 22 of the base 12 includes a top surface 54 and a pair of sidewalls 56 extending from the top surface 54. A pair of U-shaped openings 58, 60 are defined in each end 62, 64 of the top surface 54. The top surface 54 and sidewalls 56 of the faceplate 22 are positioned over the upper surface 30 and sidewalls 28, respectively, of the mounting plate 20. In positioning the faceplate 22 on the mounting plate 20 the U-shaped openings 58, 60 of the faceplate 22 are aligned with the U-shaped openings 36, 38 of the mounting plate 20.

Still referring to FIG. 3, the first support member 14 includes base, preferably a first conical base 66 having a recess 68 and a support rod 70 that is secured to and extends from the first conical base 66. A circumferentially extending groove 72 (as show in FIGS. 3–4) is defined around the first conical base 66. The groove 72 engages U-shaped openings 36, 58 of the base 12 (when the faceplate 22 is secured to the mounting plate 22) to thereby secure the first support member 14 to the base 12. A lower portion 74 of the first conical base is cut away on a side 76 of the first conical base 66 opposite the direction of insertion of the concal base 66 into the base 12 to provide a face surface 78 that allows additional room for the positioning of an end cap 40. An axially extending tap 77 (see FIG. 4) is disposed in a bottom of the first conical base 66 and is engaged by a screw 79 that extends through an aperture in the lower surface 26 of the mounting plate 20 to secure the first support member 14 to the base 12.

The first support member 14 is preferably constructed of steel. However, other metals or alloys having the requisite strength characteristics can also be used in the construction of the first support member 14. For example, the first support member 14 can be constructed from a polymer material, e.g., plastic, or a reinforced material e.g., carbon fiber or TEFLON®.

Referring now to FIGS. 2–5, the support rod 70 extends from the first conical base 66 and preferably includes an opening 80 at an end 82 opposite the conical base 66. It will therefore be appreciated that the support rod 70 may be a tube or cylinder that is affixed at one end to the first conical base 66 and is open at an opposite end or a solid rod having a recess defined in one end. The support rod 70 has a diameter of ¾ of an inch, however, a greater or lesser diameter may also be used. The opening 80 in the support rod 70 includes a notch 84 that extends from a top 86 of the support rod 70 and along the side of the support rod 70 facing the second support member 16. The opening 80 and the notch 84 are engagable by the locking bar 18 (as will be discussed below).

Figure 4:
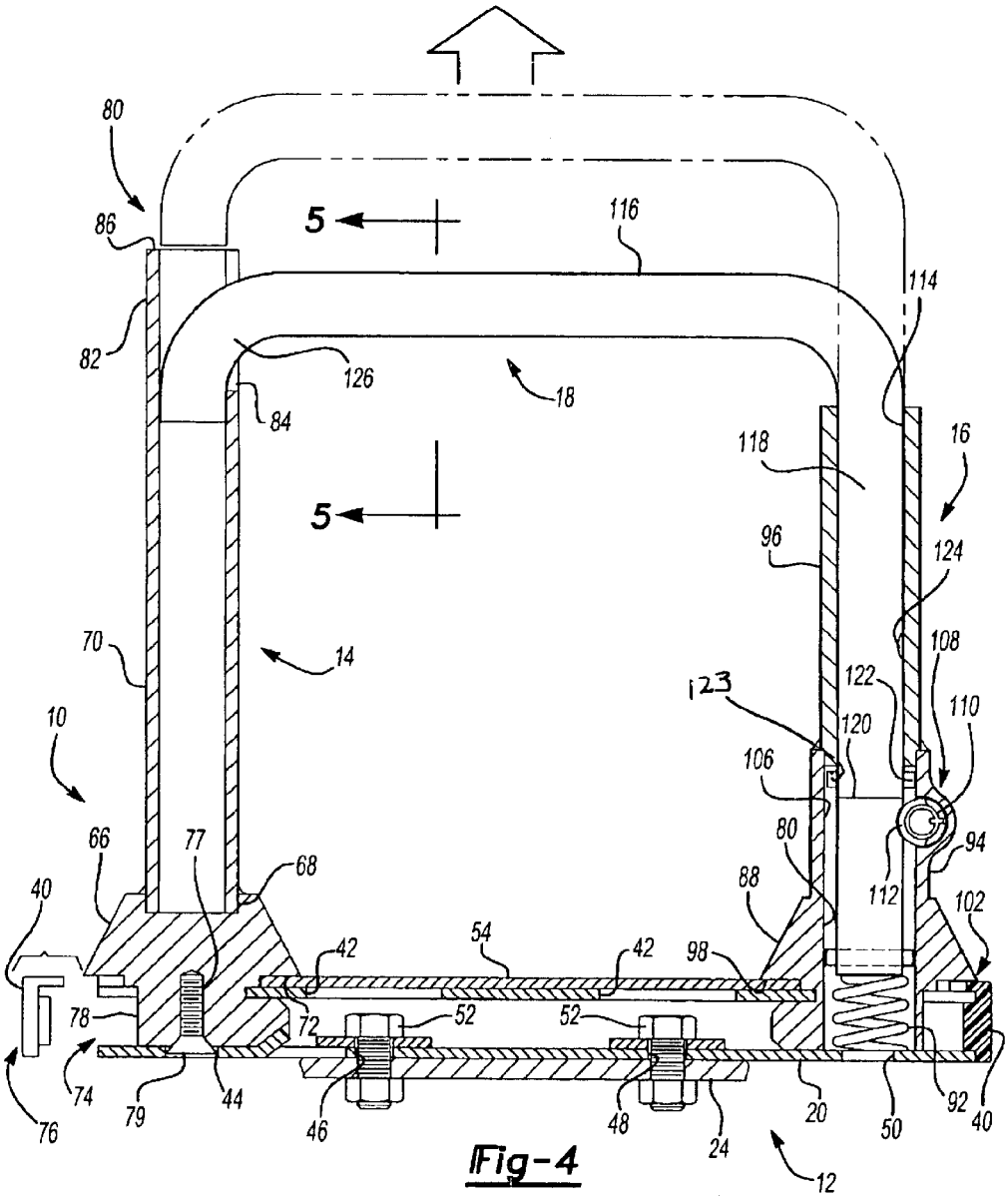
FIG. 4 is a side cutaway view of the preferred embodiment.

As shown in FIG. 4, the second support member 16 includes a base, preferably a second conical base 88 having a longitudinally extending axial bore 106 extending therethrough, a spring 92 that is positioned within the bore 106, a lock housing 94 and that is secured to the second conical base 88 and a sleeve 96 that extends from the lock housing 94. As with the first conical base 66, the second conical base 88 has a circumferentially extending groove 98 that is adapted to engage a U-shaped opening 38, 60 of the base 12 (when the faceplate 22 is secured to the mounting plate 20) to secure the second support member 16 in the base 12. Since it may sometimes be necessary to remove the second conical base 88 and associated locking bar 18 (to facilitate access to the firearm, etc.), it is not necessary to secure the second conical base 88 to the base 12 by means of a screw or the like. A lower portion 100 of the second conical base 88 is cut away on a side 102 opposite the direction of insertion of the second conical base 88 into the base 12 to provide a face surface 104 that allows additional room for the positioning of an end cap 40.

As seen in FIG. 4, the lower surface 26 of the mounting plate 20 serves to maintain the spring 92 within the bore 106 of the base 88 when the second support member 14 is secured to the base 12. Alternatively, the spring 92 may be seated on a flange 104 that extends into the bore 106. As a still further alternative, a recess may take the place of the bore 106 so as to support the spring 92. As discussed below, the spring 92 engages the locking bar 18 to bias the locking bar 18 in an unlocked orientation.

Referring now to FIGS. 2–4, the lock housing 94 is secured to and extends from the second conical base 88. The lock housing 94 includes a lock apparatus 108. The lock apparatus 108 includes lock cylinder 110 having a lock cam 112 that, as discussed below, engages and disengages the locking bar 18. One having skill in the art will note that lock housing 94 can be integral with the second conical base 88.

The sleeve 96, which is preferably tubular in shape, is secured to and extends from the lock housing 94 and includes a bore 114 therethrough that communicates with the bore 106 of the lock housing 94.

The second support member 16 is preferably constructed of steel. However, other metals or alloys having the requisite strength characteristics can also be used in the construction of the second support member 16. Additionally or alternatively, the sleeve 96 can be constructed from or can be coated with a polymer material, e.g., plastic, or a reinforced material e.g., carbon fiber or TEFLON®.

Referring now to FIGS. 1–4, the locking bar 18 is an L-shaped rod having a horizontal portion 116 and a vertical portion 118. The vertical portion 118 of the locking bar 18 movably engages and extends though the bores 114, 106 of the sleeve 96 and the lock housing 94 and has an end 120 that terminates in bore 90 of the second conical base 88. The end 120 of the vertical portion 118 of the locking bar 18 is secured within the base 88 by means of a pin 122 (see FIG. 4) that extends through an aperture 123 positioned proximate the end 120. Therefore, the bores 90, 106 of the second conical base 88 and the lock housing 94 should have a diameter that is greater than the diameter of the bore 106 of the lock housing 94 in order to accommodate the pin 122. However, the diameter of the bore 114 of the sleeve 96 should be narrower than the length of the pin 122 such that the locking bar 18 is movably securable to the second support member 16. A locking groove 124 is disposed on the locking bar 18, proximate the end 120 and above the aperture 123 that is releasably engaged by the lock cam 112.

As shown in FIGS. 2–4, the horizontal portion 116 of the locking bar 18 has a vertically extending end portion 126 that has a diameter less that the diameter of the opening 80 of the support rod 70. Therefore, when in the unlocked position the locking bar 18 is free to move about the second support member 16 such that it may be moved either toward or away from the end 82 of the rod 68.

In operation, the end portion 120 of the vertical portion 118 of the locking bar 18 is biased in an upwardly or unlocked position by the spring 92. In the unlocked position the locking groove 124 of the locking bar 18 is positioned above the lock cylinder 110 such that the lock cam 112 cannot engage it. When a user aligns the end portion 126 of the horizontal portion 116 of the locking bar 18 with the opening 80 of the support rod 70 and urges the locking bar 18 into a downwardly or locked position, the locking groove 124 of the locking bar 18 is placed in alignment with the lock cam 112 such that the lock cam 112 can engage the locking groove 124 and thereby fix the locking bar 18 in the locked orientation.

Having described my invention, additional embodiments will become apparent to those skilled in the art to which it pertains.

We claim:

1. A mounting apparatus comprising:

a base;

a first support member including a conical base and a support rod extending from said conical base, said conical base being positioned on said base of said apparatus;

a second support member including a substantially conical base and a lock, said conical base being positioned on said base of said apparatus and spaced apart from said conical base of said first support member;

a locking bar, said locking bar extending between said first support member and said second support member and being engageable by said lock of said second support member.

2. The apparatus of claim 1, wherein said base of said apparatus further comprises a mounting plate.

3. The apparatus of claim 2, wherein said base of said apparatus further comprises a faceplate.

4. The apparatus of claim 3, wherein said mounting plate comprises an upper surface having a pair of ends, each end of said upper surface having a U-shaped opening defined therein and wherein said faceplate comprises a top surface having a pair of ends, each end of said top surface having a U-shaped opening defined therein.

5. The apparatus of claim 1, wherein said substantially conical base of said first support member and said second support member each further comprise a circumferentially extending groove.

6. The apparatus of claim 1, wherein said substantially conical base of said second support member includes a longitudinally extending axial bore extending therethrough.

7. A mounting apparatus comprising:

a base;

a first support member secured to said base;

a second support member secured to said base and spaced apart from said first support member, said second support member including a lock housing;

a locking bar moveably secured to said second support member, said locking bar including a vertical portion that engages said second support member and a orizontal portion that is adapted to engage said first support member;

said first support member comprising a base and a support rod extending from said base, said base of said first support member engaging said base of said apparatus; and said base of said first support member being of a substantially conical shape.

8. A mounting apparatus comprising:

a base;

a first support member secured to said base;

a second support member secured to said base and spaced apart from said first support member, said second support member including a lock housing;

a locking bar moveably secured to said second support member, said locking bar including a vertical portion that engages said second support member and a horizontal portion that is adapted to engage said first support member;

said second support member comprising a base, said base of said second support member being adapted to engage said base of said apparatus; and said base of said second support member being substantially conical in shape.

9. The apparatus of claim 8, wherein said substantially conical shaped base of said second support member includes a longitudinally extending axial bore extending therethrough.

10. The apparatus of claim 9, further comprising a spring positioned in said longitudinally extending axial bore, said spring engaging said locking bar to bias said locking bar into an unlocked orientation.

11. A mounting apparatus comprising:

a base;

a first support member secured to said base;

a second support member secured to said base and spaced apart from said first support member, said second support member including a lock housing;

a locking bar moveably secured to said second support member, said locking bar including a vertical portion that engages said second support member and a horizontal portion that is adapted to engage said first support member;

said first support member comprising a base and support rod extending from said base, said base of said first support member being adapted to engage said base of said apparatus;

said support rod including a first end and a second end, said first end being secured to said base of said first support member, said second end defining an opening, said opening being adapted to receive said horizontal portion of said locking bar; and said opening including a notch that extends from said second end of said support rod and along a side of said support rod facing said second support member.

12. The apparatus of claim 11, wherein said second support member comprises a base, said base of said second support member being adapted to engage said base of said apparatus.

13. The apparatus of claim 11, wherein said second support member further comprising a sleeve extending from said lock housing.

14. The apparatus of claim 11, wherein said lock housing includes a longitudinally extending bore and a lock apparatus.

15. The apparatus of claim 14, wherein said lock apparatus includes a lock cylinder, said lock cylinder having a lock cam.

16. The apparatus of claim 15, wherein said vertical portion of said locking bar includes a locking groove, said locking groove being engageable by said lock cam to fix said locking bar in a locked orientation.

17. The apparatus of claim 11, wherein said vertical portion of said locking bar includes a pin.

18. A mounting apparatus comprising:

a base;

a first support member secured to said base;

a second support member secured to said base and spaced apart from said first support member, said second support member including a lock housing;

a locking bar moveably secured to said second support member, said locking bar including a vertical portion that engages said second support member and a horizontal portion that is adapted to engage said first support member;

said lock housing including a longitudinally extending bore and a lock apparatus;

said lock apparatus including a lock cylinder, said lock cylinder having a lock cam; and said vertical portion of said locking bar including a locking groove, said locking groove being engageable by said lock cam to fix said locking bar in a locked orientation.

* * * * *